US005469991A

United States Patent [19]

Hämäläinen

[11] Patent Number: 5,469,991

[45] Date of Patent: Nov. 28, 1995

[54] DEVICE FOR PORTIONING A LIQUID SUBSTANCE

[76] Inventor: Eino Hämäläinen, Iso-Heikkiläntie 5, SF-20200 Turku, Finland

[21] Appl. No.: 389,967

[22] Filed: Feb. 16, 1995

Related U.S. Application Data

[63] Continuation of Ser. No. 930,423, PCT/FI91/00026, Jan. 24, 1991, abandoned.

[30] Foreign Application Priority Data

Feb. 12, 1990 [FI] Finland ..... 900672

[51] Int. Cl.[6] ..... B67D 1/08

[52] U.S. Cl. ..... 222/188; 222/214; 222/481.5

[58] Field of Search ..... 222/188, 189.01, 222/214, 481.5; 401/138, 140, 204, 205, 217, 276

[56] References Cited

U.S. PATENT DOCUMENTS

| | | | |
|---|---|---|---|
| 96,380 | 11/1869 | Barnes | 222/188 |
| 546,254 | 9/1895 | Smith | 222/188 |
| 642,787 | 2/1900 | Eakin | 222/188 |
| 857,517 | 6/1907 | Demory | 222/188 X |
| 1,601,723 | 10/1926 | Elbert . | |
| 1,959,074 | 5/1934 | Bloxsom . | |
| 1,965,089 | 7/1934 | Weingessel . | |
| 2,187,670 | 1/1940 | Suddarth | 401/205 |
| 2,187,671 | 1/1940 | Suddarth | 401/205 |
| 2,502,900 | 4/1950 | Steiert . | |
| 3,820,905 | 6/1974 | Sims | 401/140 |
| 3,960,454 | 6/1976 | Schroeder, Jr. . | |
| 4,983,060 | 1/1991 | Steinbach | 401/140 |

FOREIGN PATENT DOCUMENTS

| | | | |
|---|---|---|---|
| 766228 | 6/1934 | France | 401/276 |
| 506475 | 9/1930 | Germany . | |
| 3718141 | 12/1988 | Germany . | |
| 661890 | 3/1964 | Italy | 401/140 |
| 96304 | 7/1960 | Norway . | |

*Primary Examiner*—Gregory L. Huson
*Attorney, Agent, or Firm*—Ronald J. Kubovcik

[57] ABSTRACT

A portioning device for a liquid substance. An airtight container for receiving, holding and discharging a liquid substance is provided with a pair of apertures. An air duct for introducing air into the container is connected to one of the apertures. An air valve is provided in the air duct. A tube for discharging the liquid substance from the container is connected to the other aperture. The tube is formed into at least two loops to form an air/hydraulic lock for preventing air from flowing through the tube into the container. When air is introduced into the container through the air duct by means of the air valve, a corresponding amount of liquid is accurately portioned from the container through the tube.

2 Claims, 2 Drawing Sheets

DEVICE FOR PORTIONING A LIQUID SUBSTANCE

This application is a continuation of application Ser. No. 07/930,423 filed as PCT/FI91/00026, Jan. 24, 1991 now abandoned.

The object of the invention is to provide a device for portioning and leading a liquid substance, such as floor wax or varnish, from a liquid container by force of gravity. The liquid substance may be delivered below the container or into a portioning device such as, for example, a spreader from which the liquid can be spread on a level surface.

In connection with, for example, floor wax portioning and spreading devices, the liquid wax to be spread is usually led by means of different kinds of mechanical transfer devices or pumps onto the surface to be treated. Different kinds of regulating devices for adjusting the amount of liquid are also common in floor wax spreader devices. A disadvantage of these complex liquid transfer and regulating devices is, however, that when the substance to be portioned dries, the valves and narrow nozzles in these devices become clogged. The devices are usually also expensive.

The aim of this invention is to achieve a structurally simple and functionally reliable portioning device for liquid substances. These aims are achieved with the device relating to the invention, of which it is characteristic that

- the container is made airtight so that liquid is discharged from the container only when a corresponding amount of air enters the container,
- an air-duct provided with a valve is connected to the container for letting air in to the container when liquid is to be discharged from the container, and that
- an air/hydraulic lock is formed in the liquid tube to prevent the access of air into the container through the liquid tube.

In the device relating to the invention the liquid flows onto the surface to be treated under its own weight. The amount of liquid flow is regulated by regulating the amount of air allowed to enter the container. This device does not require a pump or other transfer device in which the liquid might dry and cause the device to clog. Neither does the device comprise any nozzles which would be difficult to clean or any valves in contact with the liquid substance. An essential aspect of the device is that the valve for portioning the liquid never comes into contact with the liquid to be portioned. The air/hydraulic lock ensures accurate portioning. The liquid and air transfer tubes are, for example, plastic tubes.

The invention is described in greater detail below, with reference to the enclosed drawings in which FIG. 1 shows the portioning device relating to the invention as a partly cross-sectional side view.

Figure 1:
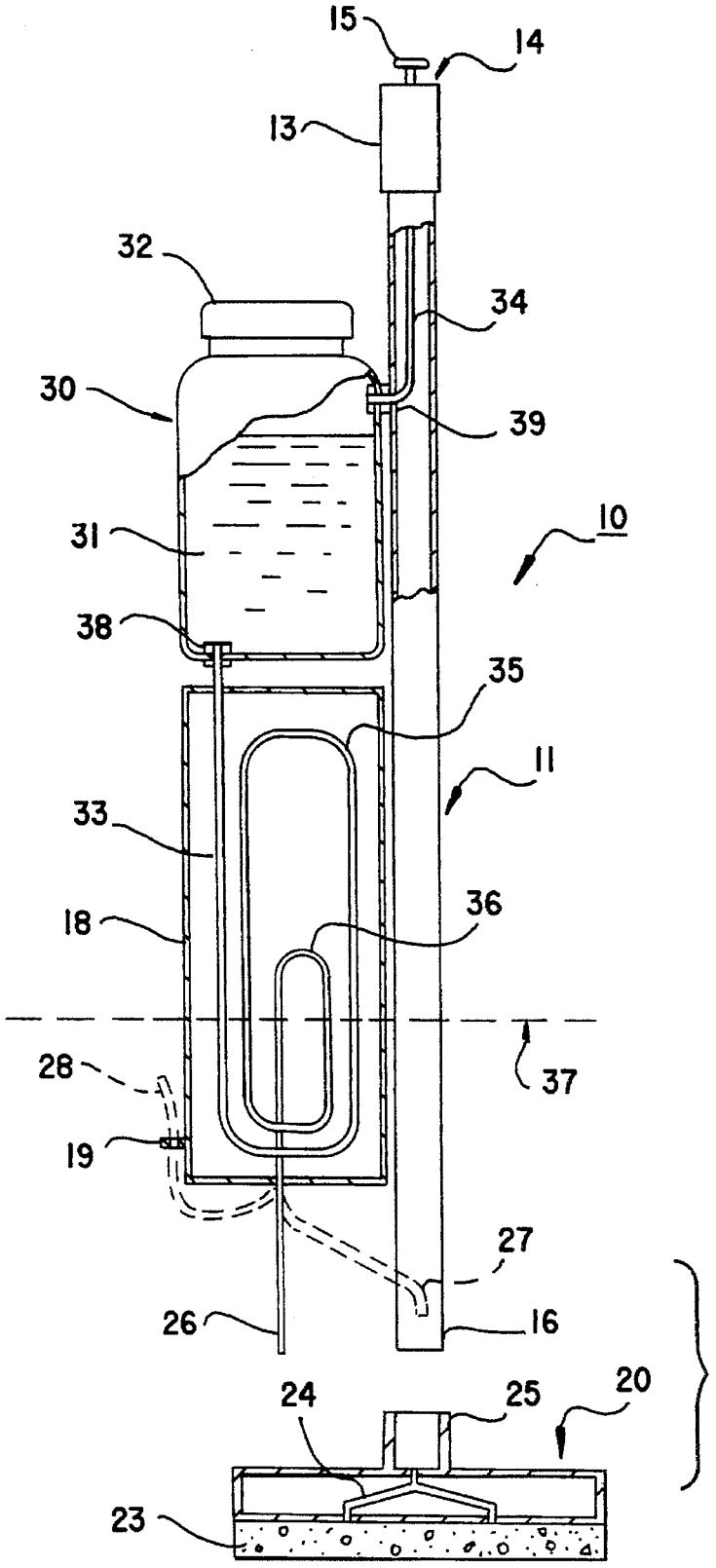

The liquid portioning device 10 shown in FIG. 1 comprises shaft 11 acting as the body of the device, container 30 connected to it, and separate spreader part 20. Container 30 is provided with lid 32, through which the liquid 31 to be portioned can be added to the container, which liquid can be almost anything—such as floor wax or varnish—depending on the structure of container 30 and device 10. In the embodiment presented in FIG. 1, container 30 contains liquid floor wax.

A liquid tube 33 is connected to the bottom of container 30 by means of packing 38, along which tube the liquid 31 to be portioned is led through housing 18 to the point of application, for example the floor, through, for example, spreader part 20. Spreader part 20 is connected to the bottom portion 16 of shaft 11 by means of connector 25, and thus the spreader part can be changed according to intended use. Since in the embodiment of FIG. 1, container 30 contains liquid floor wax, the spreader part 20 suitable for spreading floor wax includes a sponge 23 and ducts 24 for portioning liquid wax to the spreader sponge.

Air tube 34 is connected to the upper part of container 30 by means of packing 39. At the end of tube 34 there is an air valve 14. Air tube 34 runs inside shaft 11 to the top portion thereof. Air valve 14 is situated in handle 13 in order that air tube 34 can easily be opened and closed by means of air valve 14. Thus, valve 14, which regulates the portioning of the liquid, never comes directly into contact with the liquid 31 to be portioned. The structure of the air valve is described in greater detail in FIGS. 2–4.

The liquid tube 33 and air tube 34 connected to container 30 in FIG. 1 are made of flexible plastic tubing, which makes it easy to mount them into place. Thus, for example, air valve 14 can function simply so that tube 34 is flattened when the valve is being closed. Similarly, the end 26 of liquid tube 33 can be led directly out of device 10 and closed when necessary by flattening the tube. Referring to FIG. 1, the end 26 of liquid tube 33 can be turned to the side into catch 19 on the side of housing 18. This position of the liquid tube is referred to by reference numeral 28, in FIG. 1. In this position the flexible plastic tube 33 flattens and the liquid tube closes. This measure is necessary for example when lid 32 of liquid container 30 is opened for adding liquid 31. Alternatively the end 26 of the liquid tube 33 can be led inside shaft 11, as shown by reference numeral 27, whereupon liquid 31 is fed into spreader device 20.

The main principle of operation of the device shown in FIG. 1 is such that when air is allowed to enter container 30 through air tube 34, a corresponding amount of liquid 31 is discharged from the container through liquid tube 33 and flows by its own weight downwards to spreader part 20. It is obvious that liquid 31 will tend to flow out of the container, but is not discharged from it unless an equal amount of air replaces it.

It has been found in practice that in the form described above, portioning device 10 does not function accurately. By means of air valve 14 alone a significant advantage is indeed achieved that liquid 31 to be portioned never comes into contact with regulating valve 14 and thus valve 14 cannot become clogged. Accurate portioning is not, however, achieved and thus some liquid 31 may flow at the wrong time. This is because in some situations air might enter container 30 also through liquid tube 33. As a result, liquid 31 may be discharged from the container when this is not desirable.

It is also essential, therefore, to the portioning device 10 relating to the invention that two air/hydraulic locks are formed in liquid tube 33 by bending the tubular liquid tube into two loops 35 and 36. It has been found that when valve 14 of the air tube 34 is closed, the liquid level in liquid tube 33 settles approximately midway between loops 35 and 36, that is, at point 37 in FIG. 1. At the same time the liquid flow in tube 33 accurately stops. Even if the device is tilted or swung, no air is able to enter container 30 from below through liquid tube 33, due to the air/hydraulic locks formed by loops 35 and 36.

Figure 4:
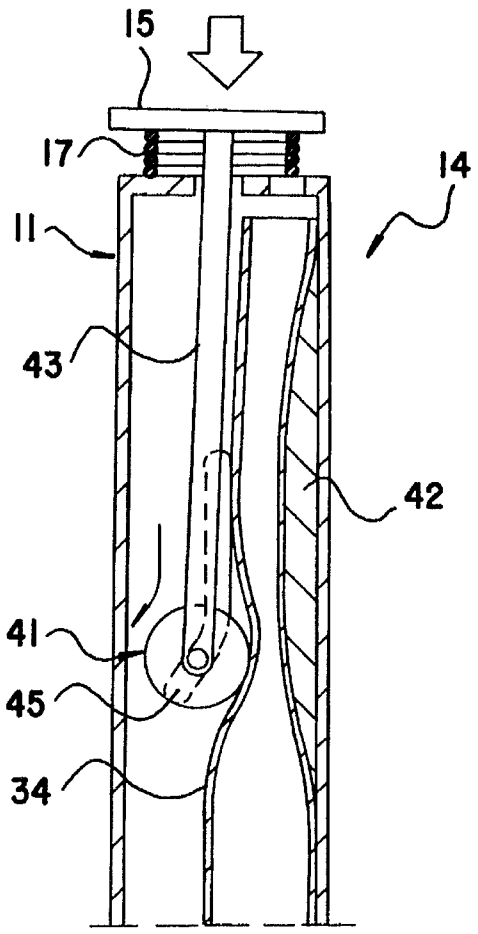
FIG. 4 shows the air tube valve shown in FIG. 2 when open.
Figure 3:
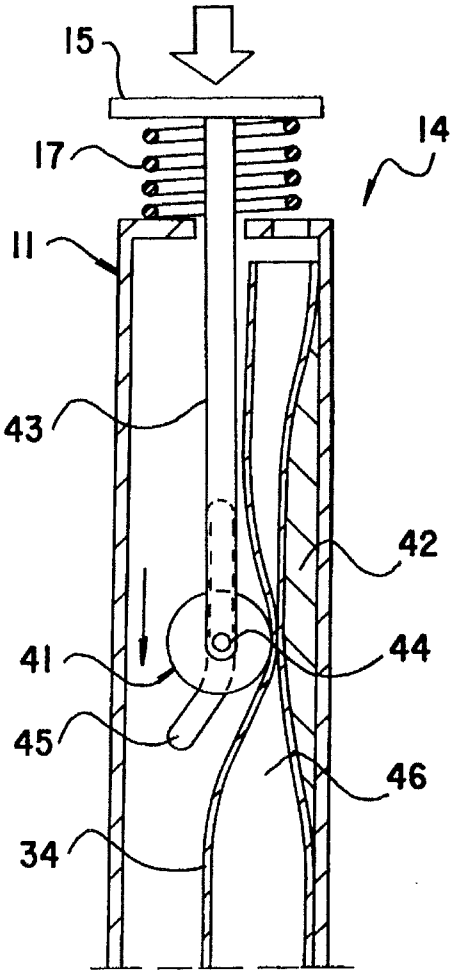
FIG. 3 shows the functioning of the air tube valve shown in FIG. 2 when being opened.

In the example, liquid tube 33 and air tube 34 are of flexible plastic tubing and shaft part 11 is a hollow metal tube. It is easy to bend the required loops 35 and 36 from the plastic tubing and the tubes with loops can be situated inside housing 18, which is a part of device 10. Air tube 34 is led through the tubular shaft 11 into valve 14 inside handle 13. Valve 14 can be a simple clamp which presses the plastic tube, but FIGS. 2–4 present a different embodiment of the valve.

Figure 2:
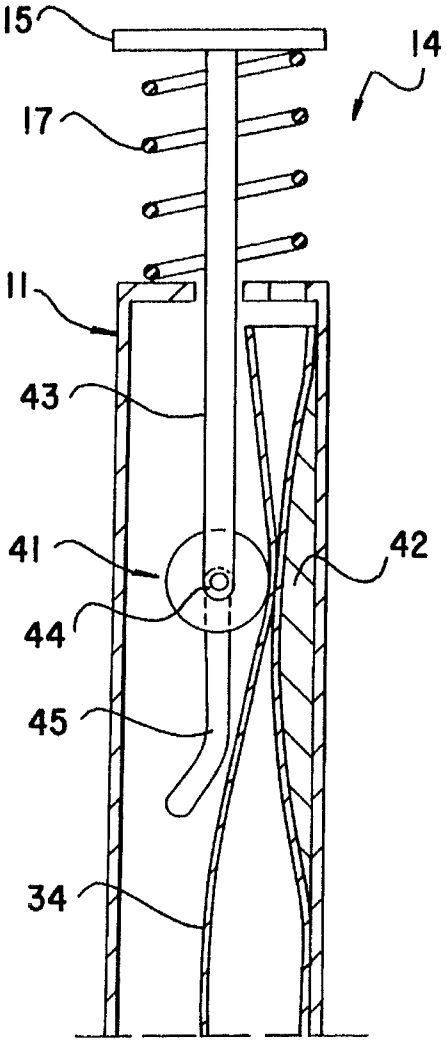
FIG. 2 shows a cross-sectional view of a preferred embodiment of an air tube valve when closed.

FIG. 2 shows a cross-sectional view of an embodiment of air tube valve 14 in the closed position. The figure shows that the end of air tube 34, made of flexible plastic tubing, is led into valve 14, in which the closing of the valve has been achieved by flattening air tube 34. For flattening the tube the valve includes roller 41, which presses air tube 34 against stopper 42. Stopper 42 can, for example, be rubber in order to achieve sufficient compression force between roller 41 and stopper 42 to flatten the tube and to close it airtightly.

Valve 14 is opened in such a way that the compression force of air tube 34 between roller 41 and stopper 42 is reduced, whereupon the flattened air tube 34, made of flexible plastic tubing, opens. Air will then enter through tube 34 into the liquid container 30 in FIG. 1, and a corresponding amount of liquid will be discharged from the container. The opening function of valve 14 is described in greater detail in FIGS. 3 and 4.

In valve 14 of FIG. 2 the compression force between roller 41 and stopper 42 is regulated so that roller 41 is moved in the direction of shaft 11. Axle 44 of roller 41 is situated in a groove 45 so that the roller can only move as guided by groove 45. Roller 41 is moved by means of push button 15, which is connected to roller 41 by means of rod 43. Spring 17 is also placed between them, which spring keeps the push button up and valve 14 closed in the position shown in FIG. 2, when push button 15 is not being pressed.

In FIG. 3 push button 15 is pressed down to open valve 14, which causes roller 41 to move in the direction of groove 45, pushed by rod 43. The figure shows that at this stage roller 41 is still pressed against stopper 42, and air tube 34, made of flexible plastic tubing, is pressed between roller 41 and stopper 42. As a result, roller 41 rolls along the surface of tube 34, pushing the air 46 inside it forward in front of it.

The functioning of valve 14, as shown in FIG. 3, can be described so that as roller 41 rolls along the surface of air tube 34, a pressure wave is formed inside the tube, which pressure wave causes liquid 31 in container 30 to move and at the same time opens any blockage in liquid tube 33. When valve 14 is being closed, roller 41 functions in exactly the same way, but in reverse order. At the closing stage the upward movement of roller 41 brings about suction in tubular air tube 34, which thus efficiently stops the flow of liquid in liquid tube 33.

FIG. 4 shows the stage which is subsequent to the situation in FIG. 3, at which push button 15 of valve 14 is pressed down, and valve 14 of air tube 34 is fully open. Roller 41 has then moved in groove 45 so that tube 34 is no longer pressed between roller 41 and stopper 42. In this situation air can enter container 30 freely, which causes liquid 31 to flow by its own weight out of container 30. The air flowing into container 30 along air tube 34 fills the volume of the discharged liquid and equalizes the vacuum which would otherwise be formed in the container.

When push button 15 is no longer pressed, spring 17 returns button 15 up again and valve 14 closes. When the flow of air into container 30 is prevented by closing valve 14, the flow of liquid 31 into liquid tube 33 and out of container 30 also stops.

The liquid which tends to flow out of container 30 into liquid tube 33 may, however, create a vacuum in the container, especially if soft plastic containers are used. The vacuum will tend to pull the walls of container 30 inwards and to suck air into the container through liquid tube 33. It might then be possible that some liquid 31 will still be able to flow into liquid tube 33. It is to avoid this situation and to ensure the functioning of the device that liquid tube 33, which is made of flexible plastic tubing, is bent to form two loops 35 and 36, as a result of which two air/hydraulic locks are formed.

When the flow of air into container 30 is prevented by closing valve 14, the continuous liquid column in liquid tube 33 breaks and the liquid level settles somewhere midway between loops 35 and 36, depending on the properties of the liquid used. The upper parts of loops 35 and 36 are filled with air because of the effect of the vacuum in the system. Once the pressure relations equalize, the flow of liquid 31 into liquid tube 33 stops.

It is obvious to a person skilled in the art that the different embodiments of the invention may vary within the scope of the patent claims presented below. The essential aspect of the invention is, however, an airtight liquid container, from which liquid is portioned by allowing a corresponding amount of air to enter the liquid container by means of an air valve. Thus, the regulating air valve will never come into contact with the liquid to be portioned and cannot, therefore, become clogged by the liquid.

I claim:

1. A device for portioning a liquid substance comprising:

an airtight container for holding and discharging said liquid substance, said container comprising a top portion and a bottom portion, said top portion being provided with a means for adding said liquid substance to the container and said bottom portion being provided with an opening for discharging said liquid substance from the bottom of the container, and said container being provided with an opening for allowing air to enter the container;

an air duct provided with a valve for introducing air into said container, said air duct being connected to the opening in the top portion of said container; and a tube for discharging said liquid substance by gravity from below the bottom of said container, said tube having first and second ends, said first end being connected to the opening in the bottom portion of said container, said second end being located below said first end, and said tube being formed into at least two closed loops between said first and second ends to form an air/hydraulic lock for preventing air from flowing through said tube into said container.

2. The device of claim 1, wherein said at least two closed loops formed in said tube are disposed in a housing.

* * * * *